US005656151A

United States Patent [19]

McLaughlin et al.

[11] Patent Number: 5,656,151

[45] Date of Patent: Aug. 12, 1997

[54] INTERMITTENT WATER WASHING TO REMOVE SALTS

[75] Inventors: Bruce D. McLaughlin; Yiing-Mei Wu, both of Sewell, N.J.

[73] Assignee: Mobil Oil Corporation, Fairfax, Va.

[21] Appl. No.: 349,651

[22] Filed: Dec. 5, 1994

[51] Int. Cl.[6] ..... C10G 57/00

[52] U.S. Cl. ..... 208/95; 208/177; 208/178; 208/208 R; 208/251 R; 208/254 R; 208/DIG. 1; 208/47; 585/950; 95/149; 95/230; 95/232; 95/233; 95/234; 95/235

[58] Field of Search ..... 208/95, 177, 178, 208/208 R, 251 R, 254 R, DIG. 1, 47; 585/950; 95/149, 230, 232, 233, 234, 235

[56] References Cited

U.S. PATENT DOCUMENTS

| | | | |
|---|---|---|---|
| 2,212,581 | 8/1940 | Babin | 196/134 |
| 2,446,040 | 7/1948 | Blair, Jr. | 208/251 R |
| 2,929,772 | 3/1960 | Gilmore | 208/99 |
| 4,098,675 | 7/1978 | Pope | 208/108 |
| 4,141,816 | 2/1979 | Crowley et al. | 208/107 |
| 4,880,568 | 11/1989 | Staley et al. | 252/548 |

OTHER PUBLICATIONS

Materials Performance, vol. 32, No. 6, Jun. 1993 "A New Form of Localized Corrosion".

Oil & Gas Journal –Jan. 3, 1994, (pp. 38–41) "Calculations Estimate Process Stream Depositions" Author: Yiing–Mei Wu.

Aiche Annual Meeting, Atlanta, Georgia, May 1994.

*Primary Examiner*—Glenn A. Caldarola

*Assistant Examiner*—Walter D. Griffin

*Attorney, Agent, or Firm*—Malcolm D. Keen; Thomas W. Steinberg

[57] ABSTRACT

A process for determining if intermittent water injection is the best way to remove deposits such as salts from refinery process streams. A water vapor pressure, P1, at stream conditions and a water vapor pressure, Ps, at saturation conditions in the stream, are used to calculate a ratio P1/Ps. If the ratio is less than 0.1 intermittent water washing is preferred. An optimized intermittent injection procedure, frequency, duration, and constraints, is disclosed. Chemical speciation calculations ensure that all accumulated salts are removed, and that an aqueous phase forms downstream of the water injection point having a salt concentration within acceptable limits.

11 Claims, No Drawings

INTERMITTENT WATER WASHING TO REMOVE SALTS

FIELD OF THE INVENTION

This invention relates to removing salt deposits from refinery and petrochemical streams by water washing and minimizing corrosion during water washing.

BACKGROUND OF THE INVENTION

Petroleum refiners have been removing salts from crude oil and product fractions almost since the dawn of refining.

Crude oil contains salts and salt precursors such as nitrogen and sulfur compounds. Salt is removed upstream of fractionation equipment to prevent salt deposition in columns and associated equipment. Simple water washing will remove these salts, and most refiners now use "desalters."

Modern refining techniques also produce salts or sometimes introduce salts into process streams.

The main source of the produced salts is chemical reactions between an acidic or basic compound dissolved in the oil and an acid or base added or created during refinery processing. Thus nitrogen and sulfur compounds in the feed are frequently converted to hydrogen sulfide or ammonia. Another impurity, hydrogen chloride, can be produced by hydrolysis of calcium and magnesium chlorides or by hydrogenation of organic chlorides. Ammonia will react with hydrogen sulfide and hydrogen chloride to produce ammonium hydrosulfide and/or ammonium chloride, respectively.

Salts can be introduced into a refinery stream when a catalyst contains leachable alkaline or acidic components. Thus platinum reforming catalyst can introduce chlorine into reformate and to the reformer off gas.

These salts, regardless of source, can form either solid deposits or an aqueous phase if water is present.

Although salt deposits, or formation of salt solutions, might seem like minor problems the opposite is the case. Salt deposits can plug distillation column internals, and shut down an entire refinery. The salts are also hygroscopic and attract water to form extremely corrosive regions. Corrosive salt solutions can and do eat holes in refinery vessels.

As an example of how serious the problem can be, on May 5, 1988 at about 3:30 a.m. an explosion occurred at a Louisiana refinery which resulted in 7 fatalities, 28 injuries, and significant property damage.

A depropanizer associated with a large FCC unit had experienced condenser fouling. To control fouling (salt buildup in the condenser tubes) water washing was begun. Wash water containing ammonia was injected into the vapor stream to maintain the pH in the condenser boot between 6.5 and 8. Despite use of an alkaline water wash, a localized region of high $H_2S$ absorption and $H_2S$ acidification developed downstream of the water injection nozzle. The resulting iron sulfide corrosion products were a porous scale at this point in the pipe, which allowed more $H_2S$ to accumulate. The net result was that about 100 square inches of metal was ejected from an 8" pipe elbow about 1.1 m downstream of the water injection nozzle. This depressured the depropanizer into the refinery, forming a vapor cloud which exploded. More details of the failure are reported in the paper entitled "A new form of localized corrosion" in Materials Performance Vol. 32, No 6, June 1993., which is incorporated by reference.

It is also worth noting that although the explosion occurred in May of 1988, it took roughly five years, until June of 1993, to publish the report, which refers to "unpredictable high rates of $H_2S$ absorption at the turbulent periphery of the water splash zone . . . "

This paper and the disaster exemplify the state of the art in refinery processing, namely controlling water injection based on boot water pH, and relying on inspection to check for localized corrosion problems. Such a retrospective approach can lead to tragic results, though it may be that nothing could have prevented the localized corrosion which occurred in that FCC unit.

We discovered that much of the corrosion that occurs in refinery and chemical process equipment is predictable and avoidable. Before getting into our new method of controlling water washing, it is instructive to review salt formation or introduction and conventional practices associated with salt removal. The review is by no means complete, but illustrates some of the complexities of salt formation and removal. Salt formation in a "wet" process (crude distillation) and a "dry" process (catalytic reforming) will be considered, with some discussion of salt formation mechanisms along the way.

Salt Formation During Crude Distillation—Wet Process

In a typical crude unit, the whole crude passes through one or more stages of heat exchange. The crude is heated to some extent, and heat is recovered from various product and/or reflux streams. The crude is then desalted by mixing with water and separation, which may involve electrostatic precipitation to help remove water droplets. Desalting significantly reduces, but does not eliminate, the salt content of the crude. Desalting can add some undesirable materials to the crude. Desalting uses refinery water streams, which frequently contain dissolved and/or entrained species which can enter the crude oil either by entrainment or via liquid/liquid extraction.

Desalting is never perfect, so significant amounts of salt always remain in the crude. In most crudes these salts are primarily calcium and magnesium chlorides. While desalting involves a water removal stage, there is always some water entrained and/or dissolved in the crude after desalting.

The desalted crude, still containing some calcium and magnesium chlorides and with entrained water added by the desalting step, is then further heated by heat exchange with various hot product streams from the atmospheric tower, the vacuum tower or both. The heat exchanged crude then passes through a direct fired heater to the atmospheric tower where the vaporized distillate is fractionated into various product fractions.

In most refineries stripping steam is added to the atmospheric tower, to product strippers associated with the atmospheric tower, to the vacuum tower and to product strippers associated with the vacuum tower. Steam aids fractionation, in part by creating a "pseudo vacuum". If half the atmosphere in a tower is steam, the hydrocarbon partial pressure is reduced, so that the tower operates as if it were at a lower pressure.

Most refineries recover a gasoline overhead product, naphtha, kerosene, light gas oil, heavy gas oil, and a residual or bottom fraction. The gasoline overhead product is condensed and pumped to a stabilizing system. The liquid streams of naphtha, kerosene etc. pass through strippers and further treating facilities. The bottoms may be used as fuel, or sent to a vacuum distillation unit to recover a vacuum gas oil fraction from a vacuum resid bottoms product.

The crude contains impurities that contribute to ammonium chloride and hydrosulfide salt formation. The impurities generally include sulfur, chlorine and nitrogen compounds which are discussed below.

Sulfur Compounds

Sulfur compounds are present in all crude oils. During high temperature processing, such as occurs in the fired heater and in the lower regions of the crude column, some of the sulfur compounds decompose to form hydrogen sulfide, a key ingredient in hydrosulfide salts.

Chlorine Compounds

Hydrogen chloride can be produced by a variety of reaction mechanisms:

1. hydrolysis of calcium and magnesium chlorides, 2. metathetic reaction between sodium chloride and organic acids, and 3. hydrogenation of organic chlorides.

Nitrogen Compounds

Ammonia enters the crude unit primarily through the desalter wash water. The desalter wash water usually contains about 50 to 100 ppm of ammonia. Since the desalted crude will always have some entrained water, ammonia is invariably carried into the crude tower. Another source of ammonia is hydrogenation of organic nitrogen compounds present in the crude, which can occur to some extent during distillation.

Ammonia and hydrogen chloride can react as they travel up the crude tower to produce ammonium chloride. Copious amounts of ammonium chloride can also be formed in the overhead system itself if ammonia is added as an overhead neutralizer. At lower temperatures this ammonium chloride can precipitate as a solid, directly from the vapor phase, in the upper portions of the atmospheric tower or in the overhead system.

The immediate result is fouling. The fouling can be so severe that there is a significant increase in pressure drop through the column and overhead system. This is usually followed by underdeposit corrosion. Ammonium chloride deposits are hygroscopic, they tend to abstract water from the vapor phase to form a saturated solution of the chloride salt. Saturated solutions of ammonium chloride are acidic and highly corrosive.

Ammonia present in the column, or overhead system, may also react or combine with hydrogen sulfide to form ammonium hydrosulfide, sometimes called ammonium bisulfide. Like ammonium chloride this salt precipitates directly from the vapor phase, forming deposits of ammonium hydrosulfide. Ammonium hydrosulfide is also hygroscopic, so such fouling is usually followed by underdeposit corrosion.

Refiners are aware of the problems of fouling and corrosion in the crude unit and work hard to prevent or at least deal with it. Most refiners use chemical additives such as neutralizer/corrosion inhibitor injection or water wash or a combination of both. The water injection rate is usually based on some "rule of thumb". The typical place for water injection is usually upstream of one of the overhead condensers associated with the column, though usually with no thought to thermodynamic or chemistry considerations.

Plugging of the overhead lines, and less frequently of the tower trays, has been experienced by refiners who picked the wrong injection locations. Additional problems were possible if an incorrect amount of water was added.

If not enough water is injected, or if the flowing stream is too hot and vaporizes all the injected water, then solid salt deposition may occur where there is no aqueous phase present to dissolve the salt. Salts will deposit, followed by corrosion under the salt deposits. Similarly if water is added in the proper amount but too late then fouling may occur upstream of the point of water injection.

Yet another possibility is that enough water will be injected to dissolve salts as they deposit, but not dilute them sufficiently. This produces a corrosive concentrated salt solution. Adding too much water generates unnecessary amounts of waste water.

Unfortunately, the way modern refineries operate there is no way to avoid this problem during crude fractionation. Crude oil always has some salt in it, and some water either dissolved, entrained or in the form of a stable emulsion sometimes called bottoms settlings and water, BS&W. Eliminating desalting might reduce the amount of entrained water attributable to desalting charged to the crude column, but would increase the salt load on the column. Operating with multiple stages of desalting, or hotter water during desalting, would reduce salt content of the crude, but there would still be some salt and likely more water entrainment. There could be more water and more ammonia fed to the crude column even as salt traffic was reduced. This may increase the likelihood of a water phase forming prematurely in the overhead system and promote formation of ammonium compounds.

To summarize, there is no way known to eliminate salts from the crude column. The crude column is inherently wet, at least in the overhead stages, so both salt deposition and salt solution corrosion must be considered.

Such "wet" processes require continuous water washing, but not all processes are wet, nor is continuous water washing always the optimum way to remove salts. If the process with a salt problem is "dry", there usually is no corrosion problem, just a fouling problem. To continuously inject wash water into such a dry process stream creates a corrosion concern and multiplies the volume of waste water generated by the process. The corrosion concern comes about because the aqueous solution formed by water injection can be corrosive. The continuous injection of water can generate very large waste streams.

The process of our invention is directed toward selecting those units where intermittent (as opposed to continuous) water injection is optimum, and also for determining what kind of intermittent water injection program is needed. One type of process which is "dry", and which requires intermittent water injection will be reviewed next, catalytic reforming.

Salt Formation During Reforming—Dry Process

Pt reforming is a dry process. Reformer feed is a clean, hydrotreated material. Even such clean processes can have a significant salt problem, but here much of the salt formation is attributable to the refinery process, catalytic reforming, rather than to the presence of impurities in the feed.

Catalytic reformers pass hydrotreated feed over chlorine containing Pt Catalyst. Chlorine, or possibly some other halogen, is part of the reforming catalyst to impart the desired acidity to the catalyst. Some of this chlorine is "washed" or leached from the catalyst, even though the reforming reaction atmosphere is dry, i.e., has less than 100 ppmv $H_2O$. Chlorine reacts with the minor amounts of ammonia, etc. present in reformate to form chlorine salts which deposit in the reformer fractionator impairing its operation.

Refiners have tried to cope with the problems of chlorides in reformate using a variety of approaches, reviewed below.

1. Water Washing

Water washing of a depropanizer associated with a continuous catalytic reformer was reported in Example 2 of U.S.

Pat. No. 4,880,568. Periodic water washing for a severe fouling and corrosion problems was not effective so "an elaborate continuous water wash system was installed. The continuous water wash system also failed to solve the deposit problem."

Continuous water washing can create a corrosion problem where none existed before. In a dry atmosphere, chlorine salts are not corrosive, though they will plug equipment. As soon as water is added, a corrosive salt solution forms, and unless all the chlorine salt is removed the salts left unwashed will be soaked with water and highly corrosive.

One of our refineries tried using an aqueous, alkaline treatment of the reformate liquid upstream of the debutanizer. A dilute caustic was injected into reformate intermediate the V/L separator and the debutanizer. The caustic was less than 15° or 20° Be (or roughly 10 to 15 wt % NaOH). A mesh pad was used to aid in separation of caustic/reformate in a separator vessel. The experiment was not considered a success as a flow control valve corroded, and the experiment was stopped.

The engineer responsible for the reformer at this refinery was very concerned about using water injection to remove chlorides, primarily because the dry reformate stream was not corrosive, but it became corrosive if water injection was used. Other approaches considered, solid bed treating and chemical treatment, are reviewed next.

2. Solid Adsorbent Treating

Some refiners use beds of solid adsorbent to prevent chloride corrosion and fouling. More details about this are available from UOP Inc. Des Plaines, Ill., which has approved use of at least one type of solid adsorbent to remove chlorides from reformate.

Solid adsorbent beds can cost a lot. They can also plug, and many refiners are reluctant to use that approach.

3. Chemical Treatments

Several patents are directed at treatment chemicals which can be injected into the reformate stream. These chemicals inhibit the formation of ammonium chloride to keep chlorine compounds in a form which will not precipitate as a solid in process equipment. Some chemical treatment programs also include chelating agents and/or film forming agents to prevent further corrosion.

U.S. Pat. Nos. 5,282,956 and 5,256,276, which are incorporated by reference, disclose inhibiting ammonium chloride deposition by adding an amide such as 1,3-dimethyl-2-thiourea or phosphatide such as lecithin.

U.S. Pat. No. 4,880,568, METHOD AND COMPOSITION FOR THE REMOVAL OF AMMONIUM SALT AND METAL COMPOUND DEPOSITS, Staley et al, Assignee Aqua Process, Inc., Houston, Tex. taught injecting amines and chelating agents into reformate to remove and/or prevent formation of ammonium salt deposits. Amines added form amine salts with a low melting point or an affinity for trace amounts of water. This patent is incorporated by reference.

While adding chemicals to prevent formation of ammonium chloride deposits and/or chelating agents to remove metal corrosion products will help, such approaches are expensive and are not considered the ideal solution. Film forming agents may still be needed to protect metal surfaces in process equipment.

The state of the art could be oversimplified and summarized as follows:

In a dry process, such as reforming, salt removal generally focusses on removing salt deposits before equipment plugs, but without forming a corrosive salt solution in an otherwise dry stream.

Sometimes it is difficult to tell if a process is "wet" or "dry". Most refiners know that Pt catalytic reforming is dry, and that the crude column overhead system is "wet", but it is not easy to determine where other refinery processes fit in this classification scheme.

An incorrect guess can lead to inappropriate treatment. If a unit, or part of a unit is relatively dry, continuous water washing may eliminate a fouling problem but create a corrosion problem (if the salts dissolve in the wash water to form a corrosive solution) and a disposal problem. Thus if a unit is dry enough it is best to let salts deposit and wash the salts from the unit only intermittently. The water washing will still create a corrosive salt solution, but washing may be needed only a few hours a week. The corrosion occurring in such a short period will usually not be significant, and production of waste water from washing can be greatly reduced as compared to continuous water washing.

Although some units are known to be "wet", such as the crude column, and some are known to be "dry", such as reformers, there are many refinery units which are not obviously "wet" or "dry".

We discovered a way to separate refinery and petrochemical units, and pick the ones where an intermittent water injection process would be the optimum way to remove salt and impurity deposits.

Our selection method will also give plant engineers the confidence to pick intermittent water washing, as there is great reluctance in refineries to do something sporadically. Thus many refiners with chloride problems around the reformer, a well known "dry" process, still use continuous water washing, even though we know that this is not necessary and is harmful.

Once intermittent water washing is selected, there are additional concerns that must be addressed. Once water washing starts it must not be stopped until all the deposits are washed out. Leaving some salt deposits in the unit will usually cause under-deposit corrosion, due to the hygroscopic nature of the salts, so complete removal of salt deposits is crucial in an intermittent injection situation.

We have discovered how to solve the problems of intermittent water injection. Thus we calculate:

1. if intermittent, or continuous, water injection is the best way to deal with salt deposition in a particular unit;

2. the amount of water required to wash all the deposits out;

3. a suitable interval, duration and amount of water injection; and 4. the most suitable injection point location.

Thus a way has now been found to select units which will benefit from intermittent water washing, and also to optimize the intermittent water wash procedure.

BRIEF SUMMARY OF THE INVENTION

Accordingly, the present invention provides a process for optimizing water washing of a flowing process stream containing at least one member of the group of HCl, $NH_3$, $H_2S$ and mixtures, said stream flowing in a line or vessel from an inlet at an inlet temperature to a lower temperature outlet, comprising determining at at least one point in said stream a temperature and a water vapor pressure, P1, at stream conditions at that point, calculating a water vapor pressure, Ps, at saturation conditions in said stream, calculating a ratio P1/Ps, and selecting intermittent water injection when said ratio is less than 0.1 and selecting continuous water injection when said ratio is equal to or greater than 0.1.

In another embodiment, the invention provides a process for continuously depositing and intermittently removing water soluble impurities such as salts from a flowing process stream comprising continuously charging through a flow line or vessel a stream containing a minor amount of impurities comprising at least one member of the group of HCl, $NH_3$, $H_2S$ and mixtures thereof from an inlet at an inlet temperature to an outlet at a lower temperature, continuously depositing water soluble impurities as solids on solid surfaces in said line or vessel and allowing said solids to accumulate, intermittently washing solids from said solid surfaces in said line or vessel by intermittently injecting water using an injection frequency and amount determined by selecting arbitrary values for an initial process temperature corresponding to a temperature of said process stream within the range of said inlet and outlet temperatures, an initial water injection frequency; and an initial water injection rate, performing an adiabatic flash calculation based on said initial water injection rate in said process stream at said selected initial temperature to calculate a post flash temperature and check for the presence of an aqueous phase equal to at least 3 wt % of any hydrocarbon phase which may form or be present, and repeating said adiabatic flash calculation with an increased water injection rate if said aqueous phase is less than 3 wt % of any hydrocarbon phase which may form, or proceeding to the next step if said resulting aqueous phase is equal to or greater than 3 wt % of any hydrocarbon phase which may form or be present, selecting an arbitrary water injection frequency, Finj, and injection duration, Tinj, calculating an impurity deposition rate, R, equaling the amount of solids deposited between water injections and calculating chemical species present in said resulting aqueous phase at said post flash temperature to determine the concentration of ions in said resulting aqueous phase, based on assuming that all solids deposited between periods of water injection dissolve uniformly in said injected water over the water injection period Tinj, repeating said adiabatic flash calculation and said chemical speciation calculation with at least one different frequency of water injection, amount of water injection, or temperature of said process stream, until said resulting aqueous water phase has a dissolved ion concentration no greater than a predetermined maximum amount and said resulting aqueous phase is present in an amount equal to or greater than 3 wt % of any hydrocarbon phase which may form or be present.

DETAILED DESCRIPTION OF PREFERRED EMBODIMENTS

More details will now be provided about each part of the process.

The process of the present invention may be used with any refinery or petrochemical process with streams flowing from a high temperature to a lower temperature, whether in a piece of pipe or in a large process vessel such as a distillation column. Our process should not be used in refinery processes known to be "wet", or where formation of a water phase is considered inevitable. If water will continuously condense along with, or upstream or downstream of the salts or other deposits, then it would be better to use a continuous water injection scheme which is outside the scope of the present invention. Examples of processes where intermittent water injection will not be optimum are crude distillation, heavy oil hydrotreating and the like.

A threshold inquiry may involve an analysis of the process stream, to determine the nature and amount of the salt deposits if nothing is done (no water is injected). This helps predict whether solids will deposit. If solids deposit, then water washing will be needed, either continuously or intermittently.

If water washing is needed it becomes important to determine if the plant is wet or dry. If the plant is "wet", and operates with large amounts of water present, continuous water injection will likely be the optimum method of water washing. A water phase will form, and must be dealt with.

If the plant is "dry", such as a Pt reformer, then continuous water washing may not be needed and may even cause significant problems. Thus continuous water washing in a "dry" plant generates more waste (water) than intermittent, and even creates a continuous source of corrosion which could be avoided.

While some streams are known to be "dry", and some are known to be "wet", many processes, or streams in a refinery or petrochemical plant, are not easy to characterize. For these plants it is not easy to determine if continuous or intermittent water injection is appropriate.

We discovered a simple and efficient way to determine if a plant is wet or dry and to select continuous or intermittent water injection. While this study can be skipped if a plant is known to be dry or wet, usually it is best to start with this determination. The method involves calculation of the ratio P1/Ps, and the calculation procedure is discussed hereafter.

P1/Ps

A water vapor pressure P1 at stream conditions is calculated. Then the water vapor pressure at the saturation conditions (at which water condensation occurs), Ps, is calculated. Based on extensive experimentation, and an analysis of computer simulations of a variety of process streams including some known to be historically wet or dry, we determined that if the ratio P1/Ps is less than 0.1 then the process stream is far from saturation. This means the stream is "dry" and intermittent water injection should be considered. If the value P1/Ps is larger than 0.1, then moisture in the stream could be harmful when it combines with salts to form a corrosive paste, so the process stream is "wet" and continuous water injection should be considered the optimum approach. As stated above, continuous water injection, for wet plants, is not the subject of the present invention.

If saturation is not thermodynamically attainable due to an inherent property of the stream at the temperature studied the ratio may be disregarded and the stream considered "dry".

Once a plant is determined dry, either by calculating P1/Ps, or by assuming that it is dry, the focus then shifts to optimizing the intermittent injection of water.

Optimizing Intermittent Water Injection

We want to cure the disease of solids deposits in dry plants while following the admonition of ancient physicians—to do no harm. It is easy to sporadically wash salts out of process equipment if you ignore the damage done by not getting all the deposits out, or creating unnecessary amounts of corrosive solutions. It is difficult to have intermittent water injection which is both efficient and safe.

To achieve the desired results, it is necessary to consider the overall process of salt deposition, a consideration which preferable begins with a precise determination as to where salts first appear. It is also essential to determine the total amount of salt which is deposited, from the point of first deposition to the process outlet. Additional concerns are how water injection changes the characteristics of the process stream, and how the process stream affects the injected water.

We therefore calculate:

1. The first appearance temperature for each salt believed to be in the stream.

2. The deposition rate for each salt.

3. The total amount of water needed to remove all of the accumulated salt.

4. (optional) The water injection rate needed to maintain a minimum allowable aqueous phase content in any hydrocarbon phase that may form or be present.

5. (optional) The water injection rate needed to maintain a maximum salt concentration in the resulting aqueous phase.

We prefer to calculate items 1 and 2 above using chemical speciation calculations, reviewed below.

Items 3, 4 and 5 relate to the water injection rate, including the frequency and duration, and what happens to the water and to the process during the period of injection. It is essential for at least some of the water to remain in liquid phase. This can be easily determined using conventional flash calculations techniques. While this may seem a trivial concern we know of refineries where water was injected in such small amounts, or into a stream so hot, that all of the injected water was vaporized.

It is also beneficial if, during periods of water injection, sufficient water is injected so that the resulting aqueous phase is at least 3 wt % of any liquid hydrocarbon phase which may form or may already be present.

It is also beneficial if the ion concentration in the resulting aqueous phase is not too high, to minimize the possible corrosiveness of this phase. Due to the intermittent nature of our water wash process, the normal rules of thumb do not apply, and it is possible to have a few hours a week of water washing which forms a highly corrosive solution without having serious corrosion. This is because the plant only "sees" the corrosive water for 1/10th or 1/100th of the total time the plant is in operation, so much higher corrosion rates can be tolerated. Similar considerations allow formation of intermittent waste water streams with more highly acidic, or more highly alkaline, pH's than could be tolerated in a continuous wash situation.

Even though intermittent water injection permits more latitude in regards to production of more concentrated wash waters, or streams with alkaline or acidic pH's, some refiners will prefer not to produce such potentially corrosive streams. To minimize even short term corrosion concerns, refiners may also fine tune the intermittent water wash procedure to minimize corrosiveness of the resulting aqueous streams. The best tool for this is chemical speciation calculations.

To summarize, our preferred approach involves determining at what point in the process deposits start to form, the nature and amount of salts that deposit, and properties of the resulting waste water containing dissolved deposits. The preferred method of making these determinations makes much use of chemical speciation calculations, which are reviewed next.

Chemical Speciation Calculations

Such calculations should always start with a complete analysis of the process stream, at least an analysis complete enough to show all salts, salt precursors, and other compounds which might form or be present and which could deposit on the walls of piping or equipment.

Chemical speciation calculations are then done for all species known or suspected to be present, to determine at which temperature salts will deposit and the nature and amount of salts being deposited.

Many of the calculation techniques involved are the same as those used in electrochemical processing. Familiarity with the discussion on ELECTROCHEMICAL PROCESSING, Kirk-Othmer, *Encyclopedia of Chemical Technology,* 3rd Edition, Volume 8, John Wiley & Sons, 1979, pp 662–720 is presumed.

A preferred calculation method for determining the deposition starting temperature and amount is disclosed in Calculations estimate process stream depositions, Oil & Gas Journal, Jan. 3, 1994 pp 38×41, Yiing-Mei Wu, also one of the present inventors. This article is set out below (without reference to the Figures or the equations, which are substantially as set out below in the Equation Summary).

Mass Balance

All calculations typically start with a mass balance, apportioning species among all phases (usually a vapor phase, a hydrocarbon phase, and an aqueous phase).

For example, consider hydrogen sulfide. The total amount of $H_2S$ in the vapor, hydrocarbon and aqueous phases, plus any $H_2S$ related ions, must equal the total $H_2S$ content of the stream under consideration.

A calculation method has been developed to estimate the conditions and extent of ammonium chloride and ammonium hydrosulfide depositions in refinery process streams containing ammonia, hydrogen chloride, and hydrogen sulfide impurities.

Corrosion caused by ammonium chloride ($NH_4HS$) has long been a problem in the refining industry. Refining units that can be affected by underdeposit corrosion, or by plugging as a result of salt deposits, include the crude overhead system, hydrocracker, catalytic reformer pretreater, and hydrodesulfurization units.

These units usually process streams containing sulfur and nitrogen compounds, a portion of which will be converted to, respectively, hydrogen sulfide and ammonia. Another impurity-hydrogen chloride can be produced by hydrolysis of calcium and magnesium chlorides or by hydrogenation of organic chlorides.

Since salt deposition is a function of feedstock impurity, process temperature, and pressure, it is beneficial to be able to evaluate deposition propensity deductively for each susceptible stream. The evaluation should predict:

Where, or at what temperature, the salt starts to deposit

The kind of salt that deposits

The approximate amount of the depositions.

If salt deposition is indicated or predicted, several preventive measures can be considered to minimize any deposit related damage. These measures include:

Inspecting affected equipment more frequently (i.e., equipment downstream of the salt depositions).

Changing to a cleaner, less-susceptible feed

Installing water-washing operation to remove the deposits.

For the third option, the total amount of deposition and the location of first deposits are important process parameters. Enough wash water should be injected upstream of the first deposits to dissolve all the accumulated deposits.

Equations

Ammonium chloride and ammonium hydrosulfide deposits are formed in the vapor phase by the following reactions:

$$NH_4Cl_{(s)}=NH_{3(g)}+HCl_{(g)} \quad [1]$$

$$NH_4HS_{(s)}=NH_{3(g)}+H_2S_{(g)} \quad [2]$$

Depositions start when the vapor pressures of the reacting gases exceed certain values. Numerous researchers have measured or calculated those threshold pressures in an attempt to predict the deposition tendency.

The most reliable of these data will be presented and used to estimate the conditions and extent of those depositions. Note that this approach is purely thermodynamic. The important kinetic aspects, such as flow patterns and residence time, are beyond the scope of this work.

Most of the data used are based on ideal conditions; that is, no interaction between other species is taken into consideration. This can be justified because the reactions occur in the gas phase; thus interactive force between gas molecules should be small. One should not, however, exclude the possibility of such interactions.

Thermodynamics

The equilibrium constants or Reactions 1 and 2 can be written as:

$$K_1 = P_{NH3} \times P_{HCl}$$

$$K_2 = P_{NH3} \times P_{H2S}$$

where $P_{NH3}$, $P_{HCl}$, and $P_{H2S}$ are the partial pressures of, respectively, NH3, HCl, and $H_2S$ in the vapor phase.

$K_1$ and $K_2$ vary with temperature. If the product of the vapor pressures exceeds the corresponding equilibrium constant at the same temperature $NH_4Cl$ will precipitate out until the vapor pressure product decreases to its equilibrium value.

In estimating these depositions, it is the product of the vapor pressures that matters. Deposition will occur even when the stream has a small amount of HCl, as long as the $NH_3$ partial pressure is high enough, and vice versa.

Another important observation is that the deposition tendency of $NH_4Cl$ is much higher than that of $NH_4HS$. For example, when temperature is 120 F, a stream with an $NH_3$/HCl pressure product of $10^{-10}$ psia$^2$ will precipitate $NH_4Cl$ while a stream with the same pressure product of $NH_3$ and $H_2S$ will not precipitate $NH_4HS$.

Deposition tendency

The first step in determining whether deposition will occur is to do an isothermal flash calculation at the temperature in question. The vapor pressure product of $NH_3$ and HCl—and, if appropriate, $NH_3$ and $H_2S$—is then compared to the corresponding equilibrium value.

If the vapor pressure product so calculated lies below the equilibrium curve (in other words, in the region where the vapors are the stable phases), this procedure is repeated with a new, lower temperature. Because the equilibrium $K_p$ values for both salts decrease as the temperature decreases, lowering the stream temperature will introduce the onset of the salt deposition if the impurity concentration is high enough.

Once the stream temperature is so low that the calculated point is just above or on the curve, that temperature is defined as the deposition starting temperature. Ammonium chloride, ammonium hydrosulfide, or both, will deposit out of the vapor phase, thereupon bringing the pressure product back to the equilibrium value.

Extent of deposition

To calculate the amount of deposits formed, a stepwise approach is used.

Theoretically, when the stream cools down gradually from the deposition starting temperature, the system will undergo a continuous deposition process with infinitesimal changes in concentrations and temperature each time, so that the equilibrium conditions are always satisfied.

During continuous deposition the stream drops out whatever amount of $NH_4Cl$ is necessary to follow the equilibrium curve once the temperature is below the deposition starting temperature.

In reality, temperature changes are not infinitesimal. Supersaturation in concentrations is a common phenomenon. A stepwise decrease in temperature in the calculation therefore is employed.

$NH_4Cl$ is not formed until the system overshoots 20 F from the deposition starting temperature. After depositing out certain amount of $NH_4Cl$, the system is back to equilibrium. Then the next overshooting begins.

This procedure is repeated until the temperature reaches the end point (usually the water dew point). The total amount of deposits is the sum of the salt formed in each step.

Algorithm description

Using the necessary stream data (composition, temperature, and pressure), the isothermal flash temperature is determined using any process simulation software (OGJ, Jan. 14, 1991, p. 55). The partial pressures of $NH_3$, HCl, and $H_2S$ are then calculated using Equations 1–3. The equilibrium constants K1 and K2 are also calculated using Equations 4 and 5.

Once these values have been determined, one of the following four cases is possible: No deposition, only $NH_4Cl$ deposition, only $NH_4HS$ deposition, or both $NH_4Cl$ and $NH_4HS$ deposition. Except for the first case, the amount of deposit will be calculated using Equations 6–8.

The stream composition of $NH_3$, HCl, and $H_2S$ will be adjusted accordingly to account for the loss to solid deposits.

The deposition starting temperature will be recorded. Then the temperature is reduced by an predetermined, arbitrary increment and the calculation repeats at the new temperature. This process stops when the temperature reaches the minimum (usually water dew point or boot temperature).

The amount of deposition ($\Delta m$ or $\Delta n$) can be reported as a function of temperature or as a sum in the temperature range from starting deposition temperature to $T_{min}$.

Sample problem

A process stream at 361 F and 430 psia is cooled after passing through the tube side of a bank of exchangers. The outlet temperature and pressure are, respectively, 225° F. and 420 psia. The stream composition is shown in Table 1.

TABLE 1

CHARACTERISTICS OF SAMPLE SYSTEM

| Component | Moles/hr |
|---|---|
| Water | 25 |
| Hydrogen | 1.012 |
| Methane | 168 |
| Ethane | 107 |
| Propane | 95 |
| Isobutane | 87 |
| n-Butane | 94 |
| Isopentane | 159 |
| n-Pentane | 170 |
| Isohexane | 156 |
| n-Hexane | 146 |
| Methyl cyclopentane | 114 |
| Cyclohexane | 124 |
| Benzene | 40 |
| Isoheptane | 127 |
| n-Heptane | 124 |
| $C_7$ cyclo $C_5$ | 135 |
| Methyl cyclohexane | 209 |
| Toluene | 114 |
| Iso-octane | 116 |
| n-Octane | 98 |
| $C_9$ cyclo $C_5$ | 156 |
| $C_9$ cyclo $C_9$ | 157 |
| $C_9$ aromatic | 136 |
| Isononone | 98 |

TABLE 1-continued

| CHARACTERISTICS OF SAMPLE SYSTEM | |
|---|---|
| Component | Moles/hr |
| n-Nonane | 69 |
| $C_9$ cyclo $C_5$ | 82 |
| $C_9$ cyclo $C_9$ | 87 |
| $C_9$ aromatic | 59 |
| $C_{10}$ paraffin | 73 |
| $C_{10}$ naphthene | 16 |
| $C_{10}$ aromatic | 0.01 |
| $C_{11}$ paraffin | 3 |
| $C_{11}$ naphthene | 1.0E-10 |
| $C_{11}$ aromatic | 1.0E-10 |
| $H_2S$ | 5.32 |
| $NH_3$ | 0.06 |
| HCl | 0.0092 |

The changes of pressure product of $NH_3$, and HCl of the sample system as the temperature decreases are calculated. The data are the results from the isothermal flash calculations from 361 F to the water dew point temperature, which is about 160 F.

The $NH_3/H_2S$ pressure product was too small for $NH_4HS$ formation so only $NH_4Cl$ deposition was considered.

The pressure product first crosses the deposition curve at 300 F. As the temperature continues to decrease, the vapor phase becomes supersaturated with $NH_3$ and HCl. Ammonium chloride therefore deposits out between 300 F and 160 F.

The amount of deposits was initially high, but as the temperature decreased gradually (from 300 F to 160 F in 10 F increments), less and less $NH_4Cl$ deposited out. The total amount of deposits in this sample problem (n, as calculated by Equation 6) is about $9.1981\times10^{-3}$ lb-mol/hr.

Equation Summary

The mass balance, and partial pressure calculations will usually involve the following Equations;

$$P_{HCl} = \frac{n_{HCl}}{n_v} P \quad (1)$$

$$P_{NH3} = \frac{n_{NH3}}{n_v} P \quad (2)$$

$$P_{H2S} = \frac{n_{H2S}}{n_v} P \quad (3)$$

$$\text{For } HCL_{(gas)} + NH_{3(gas)} \xrightarrow{K_1} NH_4Cl(s)$$

$$K_1 = P_{HCl} * P_{NH_3} \leftarrow$$

$$K_1 = \frac{[10^{A-B/(C+T)}]^2}{4} \quad (4)$$

where $A = 9.3557$, $B = 3703.7$, $C = 232$ $$\text{For } H_2S_{(gas)} + NH3\ (gas) \xrightarrow{K_2} NH_4HS(s)$$

$$K_2 = P_{NH3} * P_{H_2S} \leftarrow$$

$$K_2 = \frac{[10^{D(T+273)^{-1.86}+Elog(T+273)+F}]^2}{4} \quad (5)$$

where $D = -1.12606 \times 10^5$, $E = 4.92291$, $F = -6.68672$ $$\Delta n = \frac{(P_{HCl} + P_{NH3}) - \sqrt{(P_{HCl} + P_{NH3})^2 - 4(P_{HCl}P_{NH3} - K_1)}}{2} \frac{n_v}{P} \quad (6)$$

-continued $$\Delta n = \left[ P_{HCl} - k\left( P_{H2S} - \Delta m \frac{P}{n_v} \right) \right] \frac{n_v}{P} \quad (7a)$$

$$\Delta m = \frac{(\delta + P_{H2S}(k+1)) - \sqrt{(\delta + P_{H2S}(k+1))^2 - 4(k+1)(P_{H2S}\delta - K_2)}}{2(k+1)} \frac{n_v}{P} \quad (7b)$$

$$\text{where } k = \frac{K_1}{K_2}, \quad \delta = P_{NH3} - P_{HCl} + kP_{H2S}$$

$$\Delta m = \frac{(P_{NH3} + P_{H2S}) - \sqrt{(P_{NH3} + P_{H2S})^2 - 4(P_{NH3}P_{H2S} - K_2)}}{2} \frac{n_v}{P} \quad (8)$$

$$R_1 = \Sigma\Delta n \quad (9)$$

$$R_2 = \Sigma\Delta m \quad (10)$$

Nomenclature

K=Equilibrium constant, $mmHg^2$

Δm=Amount of $NH_4HS$ deposit, moles

Δn=Amount of $NH_4Cl$ deposit, moles $n_{HCl}$=Moles of HCl gas $n_{NH3}$=Moles of $NH_3$ gas $n_{H2S}$=Moles of $H_2S$ gas $n_v$=Total vapor moles $P_{HCl}$=Partial pressure of HCl, mmHg $P_{NH3}$=Partial pressure of $NH_3$,mmHg $P_{H2S}$=Partial pressure of $H_2S$, mmHg P=Total vapor pressure, mmHg T=Temperature, °C.

Equilibrium Relationships

Equilibrium relationships are calculated using the equilibrium constant. The technique is straightforward:

A+B→C+D

K=(C*D)/(A*B)

Here K is the equilibrium constant, a known quantity.

Electroneutrality

Finally the whole system is checked for electroneutrality. Since we are dealing with ions, i.e., charged species, the sum of all the positive charges must be equal to the sum of all the negative charges.

While the calculations are tedious and iterative, all can be done by hand, using pencil and paper.

The calculations involved in determining when, and how much, salt will deposit can be easily made using the calculation method described in the OGJ article.

Process simulators are available which greatly facilitate much of the calculational effort, such as the process simulator available from SIMSCl, Simulation Sciences, Inc., Fullerton, Calif. Salt concentrations can be calculated using ElectroChem software, from OLI Systems, Inc., Morris Plains, N.J.

Preferred Injection Strategies—Corrosion Concerns

In an intermittent water washing procedure it is important to satisfy several constraints.

Perhaps the most important constraint is making sure that once intermittent water injection begins that all the deposits are washed out. Once started, washing must not stop until all the deposits are gone. This is because these salts tend to be hygroscopic, so if water washing is incomplete there will be a fouling problem (from salts left behind) and a corrosion problem (underdeposit corrosion).

To ensure that all deposited salts are removed it is first necessary to calculate how much salts or deposits accumulate in a given period from the inlet of the process to the cooler outlet. Chemical speciation calculations greatly facilitate this step.

Next the amount of water added must be enough to dissolve all the accumulated salts and/or solid deposits. This is almost a trivial calculation, since the solubilities of salts in water is very high. In practice, this calculation may be done inherently, as described below, where water vaporization and salt concentration in the produced aqueous phase are considered.

In addition to ensuring that enough water is added to dissolve all salts in an ideal environment, it is important to calculate what this amount of water does in the process stream. This involves selecting the appropriate location in the process stream, varying the injection frequency and duration and (optionally) checking what kind of intermittent aqueous stream is formed.

Determining the corrosiveness of the aqueous solution formed in a given process stream from injected water involves additional tedious work, which can be done by hand calculations. Fortunately, vendors have developed software programs which facilitate the calculations involved. The analysis is also somewhat simplified by adopting the following approach.

Conceptually, all processes could be considered as a length of pipe with a salt (or salt precursor) laden process stream in fully developed turbulent flow entering the inlet at a certain temperature and leaving the pipe at a lower temperature. Cooling can be accomplished slowly (natural cooling due to radiant heat loss) or quickly (use of heat exchangers, fin fan coolers, injection of reactants or quench streams). As the stream cools, salts will deposit and build up.

It will usually be preferably to first calculate if salt deposition will be a problem. In some refinery streams, salt deposits may not form. This might be because temperatures are too high or impurity concentrations so low that no salts or impurities deposit. It is also possible (especially when dealing with a process unit known to be dry) to omit this step and presume that intermittent water injection will be needed at some point in the line or piece of equipment being considered, just based on operating experiences.

Once salt deposition has been confirmed, and a point in the process selected as an initial water injection point, one which is upstream of the earliest salt or solid deposition location in the process, then an intermittent water injection program can be devised. This will be based on some arbitrary initial water injection frequency and duration; and an initial water injection rate.

In the case of many "dry" units, such as catalytic reformer, great latitude is possible regards the intervals between water washings, because the chloride levels are low enough that no fouling or plugging problems will develop in any period less than about one month. Thus for convenience, and to develop a schedule which may be easily remembered and implemented by plant operators, a refinery engineer may specify injecting wash water once a week, or once a month. For purposes of discussion, we will say that the salts are removed by injecting water wash once a week.

The engineer would then specify an initial amount of water injection sufficient to remove all the salts or water soluble solids deposited in the plant. This could be done by calculating how much salt had been deposited, or some arbitrary water injection rate and time could be used, such as 1 gallon per minute per 1,000 BPD of reformate feed, and continuing this injection for some arbitrary time period, say 1 to 8 hours.

For purposes of calculation the frequency of water injection may be Finj and the water injection duration or time duration of water injection, may be termed Tinj. The amount of water injected once a week would then be the product Tinj*(an initial water injection rate).

Next the engineer would perform an adiabatic flash calculation based on this initial water injection rate in this point in the process stream to calculate a post flash temperature. If the place where water is injected is a very hot point in the process, all the water may evaporate, meaning either much more water must be injected, or perhaps a cooler place in the process can be used for water injection.

After a water phase downstream of the injection point is confirmed, the engineer should check that the aqueous phase equals at least 3 wt % of any liquid hydrocarbon phase which may form or be present. These calculations should be repeated with an increased water injection rate if the aqueous phase is less than 3 wt % of any liquid hydrocarbon phase which may form. While it may not be necessary in some applications, it will usually be beneficial to check the salt content or ionic content of the resulting aqueous phase, and to check the pH. This is done with the arbitrary water injection frequency, Finj, and injection duration, Tinj, a calculated impurity deposition rate, R, calculating the amount of solids deposited between water injections; and calculating from this information the chemical species present in the resulting aqueous phase at the post flash temperature. This allows a determination of the concentration of ions in said resulting aqueous phase, based on assuming that all solids deposited between periods of water injection dissolve uniformly in the injected water over the water injection period Tinj.

If, e.g., the salt content or pH of the resulting aqueous phase is too high, then the process may be repeated, with more water injection for the same amount of time every week, or a more frequent water injection schedule (say twice a week), or with the same frequency and duration of water injection coupled with an increase in the amount of water injected per hour, or some combination of the above.

It also may be useful to reduce the amount of water added if the salt concentration is below some arbitrary limit, say 1 wt % or 1.5 wt %. While the slightly salty water will not generally be a corrosion problem, it does represent a much larger waste stream than is perhaps required. In this case injection of less water will reduce the amount of waste generated by the process, and could reduce the amount of corrosion that occurs during intermittent water washing.

A refiner may thus change the amount of water injected per hour either increasing or decreasing it to meet other constraints. If this is changed, it will be necessary to repeat the adiabatic flash and the chemical speciation calculations with the water injection regimen to ensure that all desired process constraints are satisfied. Usually this will involve a resulting aqueous water phase with a dissolved ion concentration no greater than a predetermined maximum amount, preferably 5 mole % and more preferably 2 mole %, and an aqueous phase present in an amount equal to or greater than 3 wt % of any liquid hydrocarbon phase which may form or be present.

While our process is by no means limited to catalytic reforming, the reforming process is an ideal candidate, because the problems of chloride in reformate are so pervasive. Accordingly, some additional details about this process will be reviewed below.

Catalytic Reforming

This process is well known and widely used, most refineries have catalytic reforming units. Essentially all catalytic reformers operate with chlorine addition, either to the catalyst prior to startup, to the feed during normal operation, or as part of a continuous catalyst regeneration unit associated with a moving bed reformer.

Reformers are available from several licensors. UOP Inc, Des Plaines, Ill. will provide both fixed and moving bed reforming units.

Conventional reforming conditions can be used, including a temperature of 850° to 1050° F., a pressure of atmospheric to 500 psig and a LHSV of 0.1 to 10 $hr^{-1}$. Most reformers operate with recycle hydrogen, with from a 1:1 to 10:1 $H_2$:hydrocarbon mole ratio.

Since catalytic reforming is known to be a dry process, it is not necessary to determine if the ratio P1/Ps is less than 0.1. The refiner may simply proceed to calculate the type of intermittent water wash procedure that will work best for dealing with the problem, which will almost invariable be chlorides when a liquid reformate stream is involved. This problem will be reviewed hereafter, followed by a review of calculation methods we prefer to use to implement the process of the present invention.

Chlorine in Reformate

Moving bed units frequently produce reformate with more than 0.5 wt ppm Cl, and often in excess of 1 wt ppm Cl, and sometimes with 2 or 3+ wt ppm Cl. Fixed bed units operating with large amounts of Cl addition due to catalyst demands or imminent shutdown for regeneration can produce reformate with like amounts of Cl, though typically moving bed units have the highest Cl levels.

Chlorine levels may be continuously, or intermittently, troublesome. Chlorine in reformate will usually be highest just before regeneration (for fixed bed units) or just before replacement of catalyst (in the case of moving bed units).

Calculation Methods

Our method can be implemented using conventional paper calculation techniques or sophisticated software. Because of the iterative nature of some of the calculations, use of a computer to perform some of the steps involved is preferred.

Illustrative Embodiment

Data and Other Pertinent Information

Consider a bank of exchangers handling Reactor Effluent at 350° C. (662° F.) and 455 psia on the tubeside. At the inlet to the last exchanger, temperature and pressure are 183° C. (361° F.) and 430 psia respectively; effluent temperature and pressure from this exchanger are 124° F. (255° F.) and 420 psia. Oxygen free, good quality wash water is injected at 102° C. (215° F.). For computational purposes, the wash water is viewed as chemically pure.

(1) The temperature of the process stream drops below 177° F. (350° F.) between the inlet and outlet of the last exchanger. Therefore, wash water should be injected into the inlet of this exchanger.

(2) According to SIMSCI simulation, the 4350 mol/hr of basic process stream at the exchanger inlet consist of 47 mol pct organic liquid and 53 mol pct vapor at 183° C. (361° F.) and 430 psia. The vapor phase contains 0.99 mol pct water; if the vapor phase can be viewed as ideal then the water partial pressure in the vapor phase of the process stream is P=(0.0099) (430 psia)=4.26 psia. Finding the water partial pressure in the vapor phase of the process stream at saturation requires the theoretical addition of water to the basic process stream, while maintaining temperature and pressure at 183° C. (361° F.) and 430 psia, until the first trace of liquid water appears. The vapor phase would contain 38.2 mol pct water when the first trace of liquid water appears. The associated water vapor partial pressure is $P_s$=(0.382)(430 psia)=164 psia. Therefore, $P/P_s$=0.026<0.1 which implies wash water should be injected intermittently. As a point of interest, the pressure of saturated steam is 156 psia at 183° C. (361° F.) which is in close agreement with the computed value of $P_s$ even though the process stream is not pure water.

(3) During non-injection of water, $9.1981\times10^{-3}$ mol/hr of HCl combines with an equal molar quantity of $NH_3$ to produce $9.1981\times10^{-3}$ mol/hr $NH_4Cl$. This is the total rate at which $NH_4Cl$ is deposited from the temperature at which $NH_4Cl$ first appears (149 C.300° F.) to the water dew point temperature (71 C, 160° F.). No $NH_4HS$ is formed in this system.

(4) One hour is tentatively selected as the duration of "slugging." Once per week is tentatively selected as the frequency of "slugging." $F_{inj}$=168 hours; $t_{inj}$=1 hour.

(5) During 167 hr of non-injection, ($9.1981\times10^{-3}$ mol/hr $NH_4Cl$)(167 hr)=1.5361 mol $NH_4Cl$ accumulates along the container wall just downstream of the injection location. Since the water "slugging" duration is one hour, the rate influx of $NH_4Cl$ into the injected water during that hour is 1.5361 mol/hr.

(6) If 102° C. (215° F.) wash water is adiabatically mixed on SIMSCI at 430 psia with a 183° C. (361° F.) process stream flowing at 4350 mol/hr, a trial-and-error procedure quickly shows that 847 mol/hr of wash water will produce a three phase mixture at 157° C. (313.9° F.) in which the liquid water phase is 3 weight percent of the liquid hydrocarbon.

(7) If the wash water and process stream from (6) and the accumulated salts from (5) are isothermally mixed on ElectroChem at 157° C. (313.9° F.) and 430 psia, then the aqueous phase pH is 3.9 and the mol pct ($NH_4^+$=$Cl^-$+$HS^-$+$S^{--}$) is 1.2 which means the pH of the aqueous phase at the injection point during the one hour injection period could be lower than the desired minimum of 5.5. Corrosion rate should be monitored at the injection point to detect the possible onset of a corrosive condition which might require treatment by neutralizing amine or ammonia.

(8) If the stream from (7) is simply cooled to 38° C. (100° F., accumulator boot or separator temperature), the pH increases to 6.7 and the mole percent ammonium, chloride, hydrosulfide and sulfide decreases to 0.4; this means the chemical composition of the aqueous phase which feeds the separator during the 1 hr/wk wash water injection is acceptable. During the remaining 167 hr/wk, the stream feeding the separator is presumed to contain $1.9\times10^{-6}$ (=$9.2\times10^{-3}$–$9.1981\times10^{-3}$) HCl, $5.0802\times10^{-2}$ (=$6\times10^{-2}$–$9.1981\times10^{-3}$) $NH_3$ and only 25 mol/hr water. 18.7 mol/hr of that water condenses at 38° C. (100° F.) to produce an aqueous phase with a pH of 8.0 and a negligible ionic content; this means the chemical composition of the aqueous phase which feeds the separator during the 167 hr/wk non-injection period falls within the guidelines and, consequently, the aqueous phase will not be excessively corrosive.

Process simulators used in this example are SIMSCI, from Simulation Sciences Inc., Fullerton, Calif., and Electro-chem, from OLI Systems, Inc., Morris Plains, N.J.

Preferably the frequency of water injection is at least once per week and the duration is at least one hour.

When intermittent water washing is practiced and said impurities are salts formed by gas phase reactions involving $HC_l$, $NH_3$ and $H_2S$ a salt deposition rate, R, is determined by analyzing said process stream to determine the concentration of $HC_l$, $NH_3$ and $H_2S$; selecting an initial point in said flow line or vessel and determining a process stream initial temperature and initial pressure at said initial point; calculating, by an isothermal flash calculation at said initial temperature and pressure, the partial pressures of $HC_l$, $NH_3$ and $H_2S$; determining a product of said partial pressures $P(HC_l)*P(NH_3)$ and $P(NH_3)*P(H_2S)$ where $P(HC_l)$, $P(NH_3)$, and $P(H_2S)$ represent the partial pressures of $HC_l$, $NH_3$ and $H_2S$, respectively; comparing said partial pressure products with a corresponding equilibrium constant at the same temperature to determine if the vapors are stable phases or will cause salt deposition; determining an initial salt deposition amount by reducing said initial temperature to a reduced initial temperature and repeating said isothermal flash calculations until a temperature is reached which causes an initial salt deposition and produces a stable vapor phase with a reduced content of at least one of $HC_l$, $NH_3$, $H_2S$ at said reduced temperature; determining an incremental salt deposition amount by selecting at least one further reduced temperature which is greater than said outlet temperature and repeating step f using said further reduced temperature to cause at least one incremental salt deposition, repeating the determination of incremental salt deposition until said further reduced temperature approaches said outlet temperature; summing said initial and incremental salt deposition amounts to estimate a total amount of salt deposition, R.

Preferably the dissolved ion concentration in the resulting aqueous phase is determined by selecting an arbitrary water injection frequency, Finj, and injection duration, Tinj; calculating the accumulated water soluble salt in the process stream, R*(Finj–Tinj); adding the salt accumulation into the process stream and determining the dissolved ion concentration in the aqueous phase and repeating until the resulting aqueous water phase has a dissolved ion concentration no greater than 2 mole %

Disclaimer and Cautionary Notice

Our process can be used to supplement conventional safety practices not to replace them. We do not want our technology to lull refiners or chemical plant operators into a false sense of security. Refiners should not assume that because routine problems associated with intermittent water washing can be eliminated there will be no problems in this area.

Refineries and petrochemical plants are filled with volatile and potentially explosive and/or toxic materials. A failure in a propane line can, in seconds, create a vapor cloud which will expand until it reaches an ignition source (such as the many fired heaters located near the process). Such vapor clouds have exploded with catastrophic results including loss of many refinery units and much injury and death.

Our approach to water washing is better than anything now available, and vastly superior to conventional "rules of thumb" but it does not eliminate risk. Our system should never be considered a substitute for normal refinery inspection practice. Annual inspections of all critical areas of each refinery unit will still be needed for safety.

Thus while our process will help predict some areas where problems are likely to occur, it must never be used as a substitute for conventional prudent inspection practice and other normal safety practices.

Part of the reason for our caution is that new processes, new catalysts, and old problems (operator error or equipment failure or miscalibration) are always with us. A water injection program that is appropriate for normal operation may be completely inadequate if a few barrels of caustic or other corrosive chemical are mixed with the feed, or show up in the wash water. Water injection pumps may fail or be shut off, feed properties may change, or a new batch of catalyst may be overchlorinated. Even if the process runs perfectly and the catalyst never changes the feed properties may change, or a laboratory analysis of feed properties may be in error. Any of these could lead to an incorrect amount of water injection and a corrosion and/or fouling problem.

Our approach is purely based on thermodynamics. Important kinetic aspects, such as flow patterns and residence time, are beyond the scope of our work.

Our method is not intended to handle localized, unusual conditions, such as hot process lines which have cold spots due to poor insulation or rain water dripping on a line. A water injection nozzle may be partly plugged, causing an uneven spray and consequent localized regions of high or low temperature. Even perfect nozzles may create localized regions of unusual pH or chemical composition around the nozzle that are difficult to calculate or even estimate.

Our process will help refiners avoid many problems heretofore created by relying on "rules of thumb" for water injection. We can even use our technology to help locate some, but not all, areas which merit more frequent inspection. Our technology should never be used to reduce or eliminate any customary inspections currently used.

While our process will not solve all problems it will effectively allow refiners and petrochemical plant operators to practice intermittent water washing without creating more problems. Many of the steps taken are simple, and may even seem obvious in retrospect, but we have never seen or heard of a publication which describes our method of selecting "dry" units, nor our approach to intermittent water washing. Not only have we not heard anyone else propose our solution, but we regularly hear of serious salt plugging and corrosion problems from all of our refineries, most of which could be completely eliminated by using our approach to water washing.

We claim:

1. A process for optimizing water washing of a flowing process stream containing at least one member of the group of HCl, $NH_3$, $H_2S$ and mixtures, said stream flowing in a line or vessel from an inlet at an inlet temperature to a lower temperature outlet, comprising:

a. determining at at least one point in said stream a temperature and a water vapor pressure, P1, at stream conditions at that point;

b. calculating a water vapor pressure, Ps, at saturation conditions in said stream, c. calculating a ratio P1/Ps, and d. selecting intermittent water injection when said ratio is less than 0.1 and selecting continuous water injection when said ratio is equal to or greater than 0.1.

2. The process of claim 1 wherein if saturation is not thermodynamically attainable due to an inherent property of said stream at said temperature, said ratio is disregarded and said stream is defined as "dry" and intermittent water injection is selected for said stream.

3. The process of claim 1 wherein said ratio is calculated at a temperature ranging from and including said inlet temperature to said outlet temperature.

4. The process of claim 1 wherein said ratio is less than 0.1 and said stream is intermittently water washed by injection of water into said stream at a point in said stream where a stream temperature is between said inlet temperature and said outlet temperature.

5. A process for continuously depositing and intermittently removing water soluble impurities such as salts from a flowing process stream comprising:

a. continuously charging through a flow line or vessel a stream containing a minor amount of impurities at least one member selected from the group consisting of HCl, $NH_3$, $H_2S$ and mixtures thereof from an inlet at an inlet temperature to an outlet at a lower temperature;

b. continuously depositing water soluble impurities as solids on solid surfaces in said line or vessel and allowing said solids to accumulate;

c. intermittently washing solids from said solid surfaces in said line or vessel by intermittently injecting water using an injection frequency, injection duration and amount determined by:

d. selecting arbitrary values for:
an initial process temperature corresponding to a temperature of said process stream within the range of said inlet and outlet temperatures;
an initial water injection frequency;
an initial water injection duration; and
an initial water injection rate;

e) performing an adiabatic flash calculation based on said initial water injection rate in said process stream at said selected initial temperature to calculate a post flash temperature and check for the presence of an aqueous phase equal to at least 3 wt % of any liquid hydrocarbon phase which may form or be pre-sent, and repeating said adiabatic flash calculation with an increased water injection rate if said aqueous phase is less than 3 wt % of said liquid hydrocarbon phase or proceeding to the next step if said resulting aqueous phase is equal to or greater than 3 wt % of any liquid hydrocarbon phase which may form or be present;

f) selecting an arbitrary water injection frequency, Finj, with dry periods between periods of water injection, and injection duration, Tinj;

g) calculating an impurity deposition rate, R, equaling the amount of solids deposited between water injections; and h) calculating chemical species present in said resulting aqueous phase at said post flash temperature to determine the concentration of ions in said resulting aqueous phase, based on assuming that all solids deposited during dry periods dissolve uniformly in said injected water over the water injection duration Tinj;

i) repeating adiabatic flash and chemical speciation calculations with at least one different frequency, duration or amount of water injection or temperature of said process stream, until said resulting aqueous water phase has a dissolved ion concentration no greater than a maximum amount and said resulting aqueous phase is present in an amount equal to or greater than 3 wt % of any liquid hydrocarbon phase which may form or be present.

6. The process of claim 5 further comprising repeating said adiabatic flash and chemical speciation calculations until said resulting aqueous water phase has a dissolved ion concentration no greater than 5 mole %.

7. The process of claim 6 wherein said dissolved ion concentration is no greater than 2 mole %.

8. The process of claim 5 wherein said frequency of water injection is at least once per week.

9. The process of claim 5 wherein said duration of water injection is at least one hour.

10. The process of claim 5 wherein said impurities are salts formed by gas phase reactions involving HCl, $NH_3$ and $H_2S$ and a salt deposition rate, R, is determined by:

a. analyzing said process stream to determine the concentration of HCl, $NH_3$ and $H_2S$;

b. selecting an initial point in said flow line or vessel and determining a process stream initial temperature and initial pressure at said initial point;

c. calculating, by an isothermal flash calculation at said initial temperature and pressure, the partial pressures of HCl, $NH_3$ and $H_2S$;

d. determining a product of said partial pressures:

$$PHCl*P(NH_3, \text{ and}$$

$$P(NH_3)*P(H_2S)$$

where P(HCl), $P(NH_3)$, and $P(H_2S)$ represent the partial pressures HCl, $NH_3$ and $H_2S$, respectively;

e. comparing said partial pressure products with a corresponding equilibrium constant at the same temperature to determine if the vapors are stable phases or will cause salt deposition;

f. determining an initial salt deposition amount by reducing said initial temperature to a reduced initial temperature and repeating said isothermal flash calculations until a temperature is reached which causes an initial salt deposition and produces a stable vapor phase with a reduced content of at least one of HCl, $NH_3$, $H_2S$ at said reduced temperature;

g. determining an incremental salt deposition amount by selecting at least one further reduced temperature which is greater than said outlet temperature and repeating step f using said further reduced temperature to cause at least one incremental salt deposition, h. repeating the determination of incremental salt deposition until said further reduced temperature approaches said outlet temperature;

i. summing said initial and incremental salt deposition amounts to estimate a total amount of salt deposition, R.

11. The process of claim 10 wherein the dissolved ion concentration in said resulting aqueous phase is determined by:

a) selecting an arbitrary water injection frequency, Finj, and injection duration, Tinj;

b) calculating the accumulated water soluble salt in the process stream, R*(Finj–Tinj);

c) adding the salt accumulation into said process stream and determining the dissolved ion concentration in said aqueous phase; and d) repeating a) until said resulting aqueous water phase has a dissolved ion concentration no greater than 2 mole %.

* * * * *

UNITED STATES PATENT AND TRADEMARK OFFICE

CERTIFICATE OF CORRECTION

PATENT NO. : 5,656,151
DATED : August 12, 1997
INVENTOR(S) : Bruce D. McLaughlin, Yiing-Mei Wu It is certified that error appears in the above-indentified patent and that said Letters Patent is hereby corrected as shown below:

Claim 5, Column 21, line 13, "pre-sent" should be --present--.

Signed and Sealed this

Twenty-third Day of December, 1997

Bruce Lehman

*Attest:*

BRUCE LEHMAN

*Attesting Officer*

*Commissioner of Patents and Trademarks*